United States Patent [19]

Meyer Thor Straten

[11] 4,257,613

[45] Mar. 24, 1981

[54] DART AND DARTBOARD THEREFOR

[76] Inventor: Peter Meyer Thor Straten, 54, Breitenburgerstrasse, D-2210 Itzehoe, Fed. Rep. of Germany

[21] Appl. No.: 15,211

[22] Filed: Feb. 26, 1979

Related U.S. Application Data

[63] Continuation-in-part of Ser. No. 812,701, Jul. 5, 1977, abandoned.

[30] Foreign Application Priority Data

Jan. 21, 1977 [DE] Fed. Rep. of Germany ..... 2702502

[51] Int. Cl.[3] ..... A63B 65/02; F41J 3/00

[52] U.S. Cl. ..... 273/347

[58] Field of Search ..... 273/106.5 A, 106.5 R, 273/102 B, 347, 419, 420

[56] References Cited

U.S. PATENT DOCUMENTS

| | | | |
|---|---|---|---|
| 2,808,266 | 10/1957 | Rose | 273/102 B |
| 2,876,760 | 3/1959 | Halverson | 273/106.5 R |
| 3,784,199 | 1/1974 | Chmela | 273/106.5 R |
| 3,900,778 | 8/1975 | Bruner | 273/102 B |
| 3,957,271 | 5/1976 | Kurtz et al. | 273/106.5 R |
| 3,976,298 | 8/1976 | Hinchman | 273/166.5 R |

FOREIGN PATENT DOCUMENTS

| | | | |
|---|---|---|---|
| 65719 | 3/1914 | Austria | 273/102 R |
| 2643228 | 3/1978 | Fed. Rep. of Germany | 273/102 B |
| 667657 | 6/1929 | France | 273/106.5 R |
| 1334767 | 7/1963 | France | 273/102 R |
| 613190 | 11/1960 | Italy | 273/102 B |
| 679970 | 9/1952 | United Kingdom | 273/106.5 R |

*Primary Examiner*—Paul E. Shapiro

*Attorney, Agent, or Firm*—Heinrich W. Herzfeld

[57] ABSTRACT

A dart game is described which consists essentially of a dart comprising (a) a cone-shaped nose part having a base and a rounded tip, (b) a tail part bearing fins, (c) a stem part connecting the tail part with the base of the nose part, and (d) a ballast member intermediate the tail part and the nose part and being adaptable for being shifted during flight from a position adjacent the tail part toward said nose part, and a dartboard. A preferred dartboard comprises (α) a base part having a front face, (β) a layer of dart-holding projections on the front face, each of the projections protruding substantially at right angle from the front face and being elastically flexible and deflectable by the nose part of the dart when the latter penetrates into the layer, and (γ) engagement means on both the dart and the projections, the engagement means of the dart being adapted for engaging the engagement means of at least two of the projections when the dart has penetrated the layer and the blunt tip of the nose part is at or near the front face.

2 Claims, 25 Drawing Figures

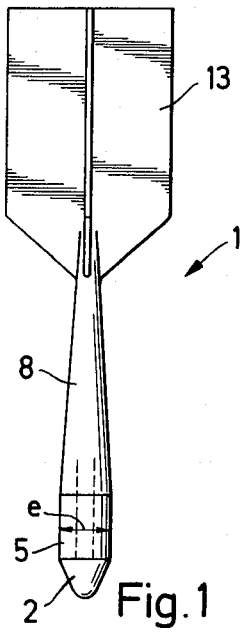
Fig. 1
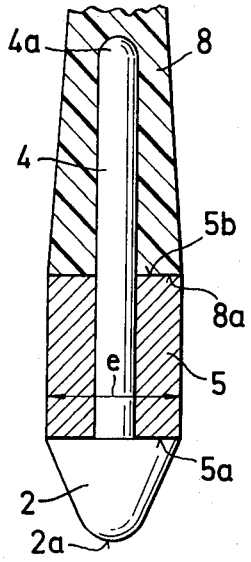
Fig. 2
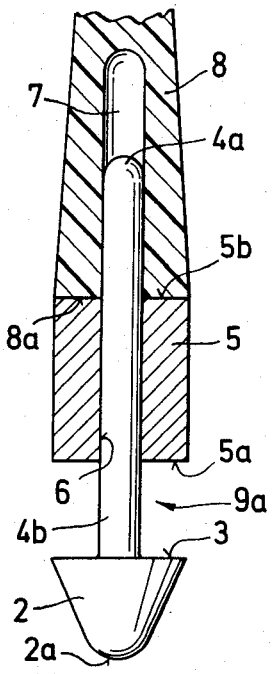
Fig. 3
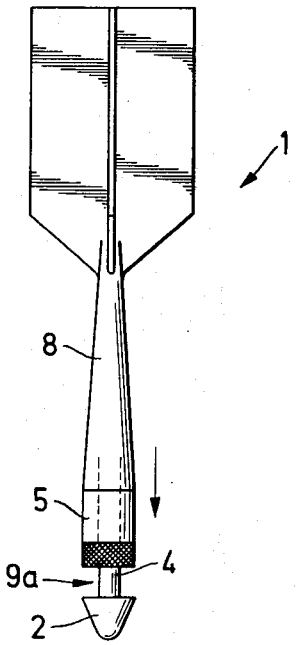
Fig. 11A
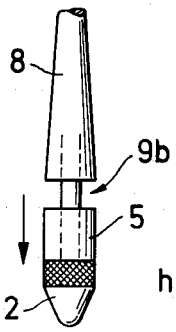
Fig. 11B
Fig. 11C
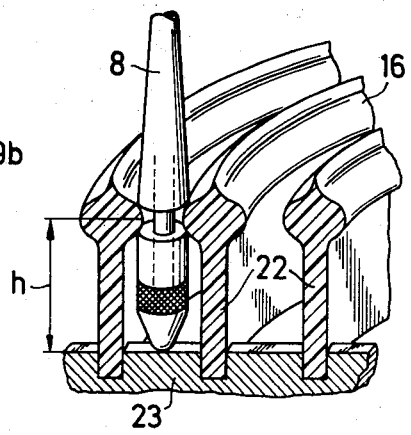

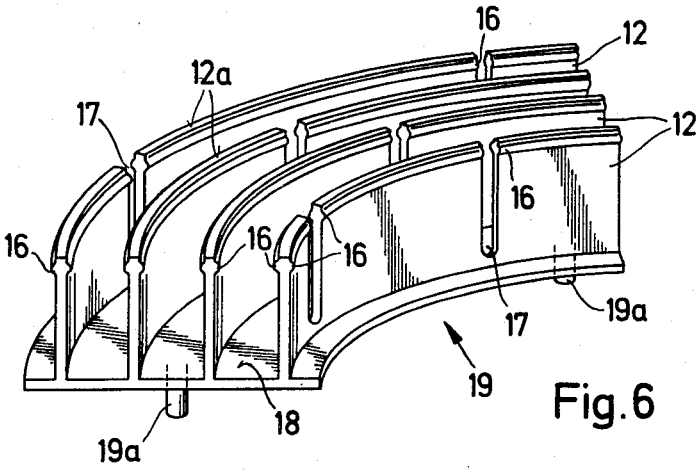
Fig.6
Fig.8
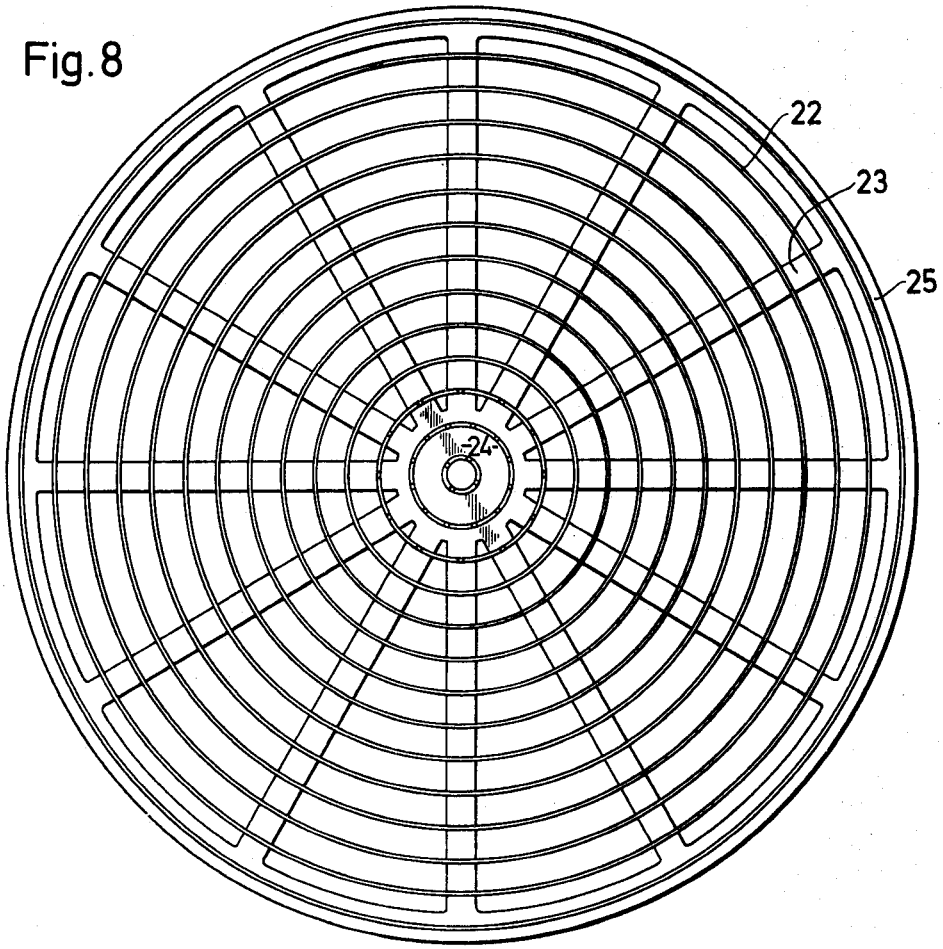

Fig. 9
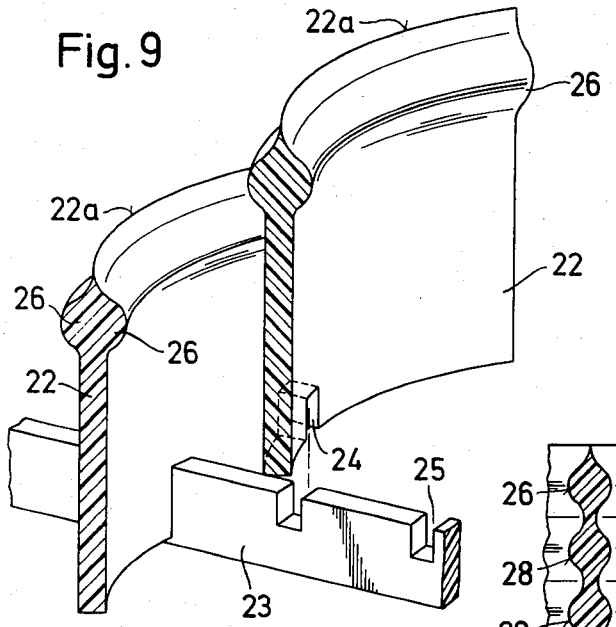
Fig. 12
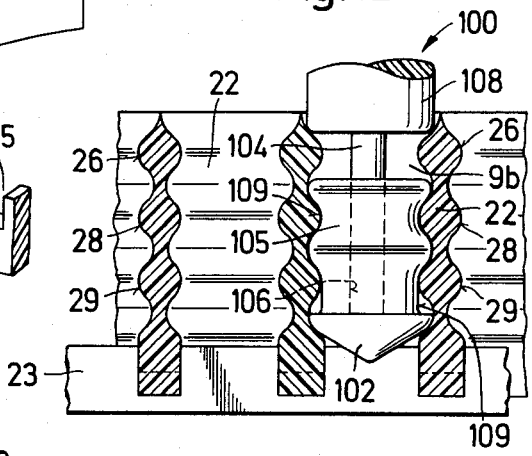
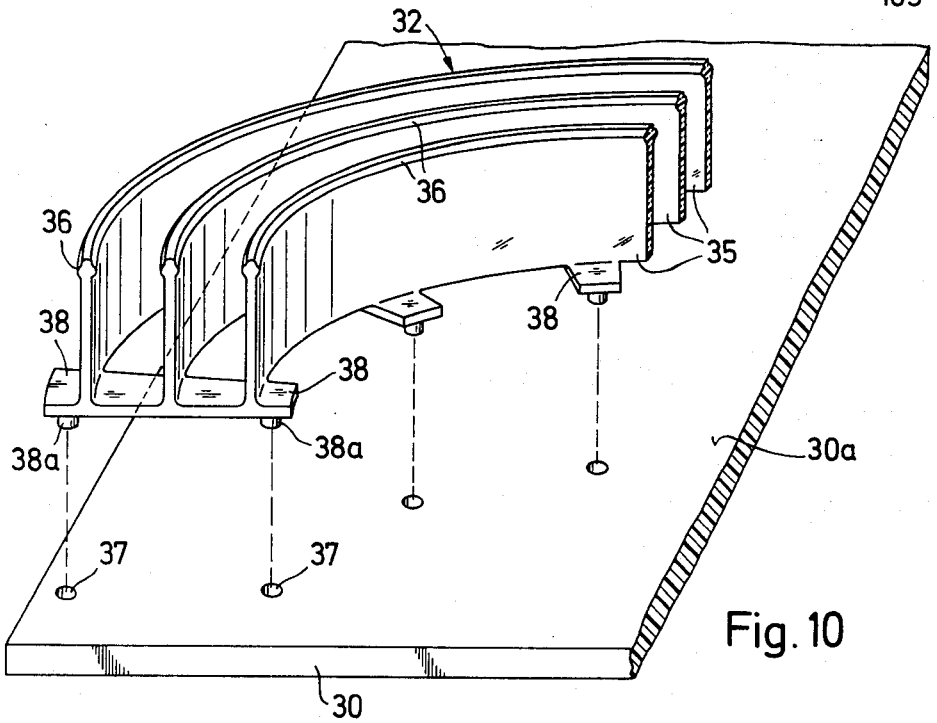
Fig. 10

Fig. 13
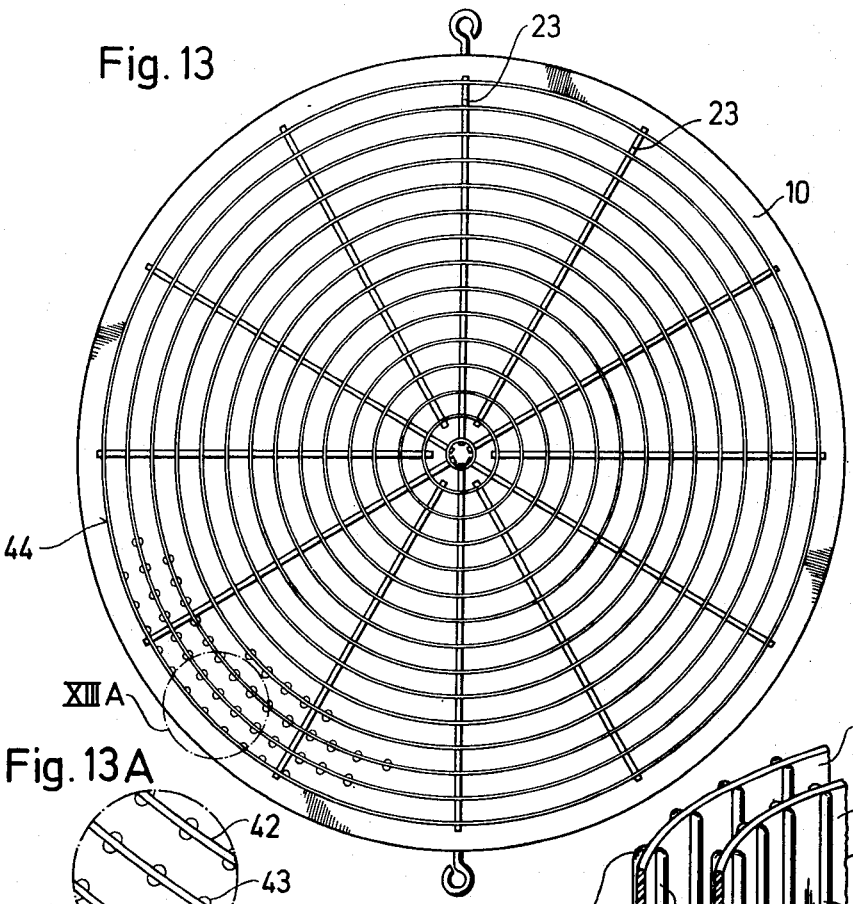
Fig. 13A
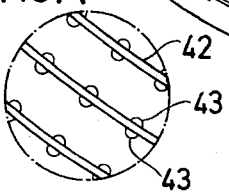
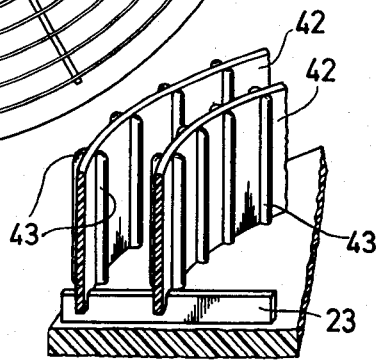
Fig. 14
Fig. 15
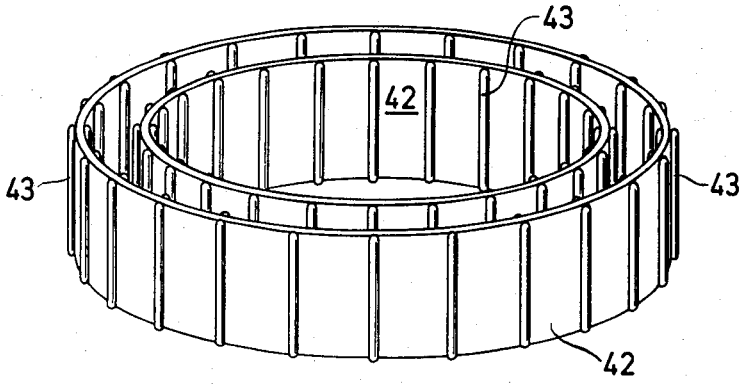

Fig. 17
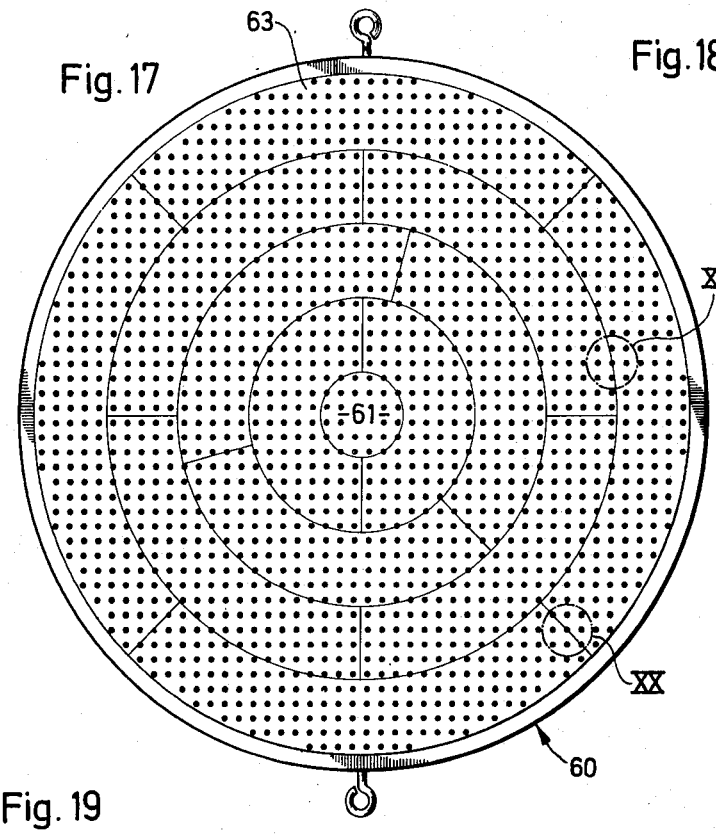
Fig. 18
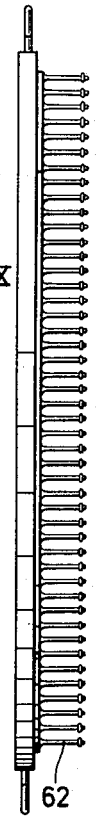
Fig. 19
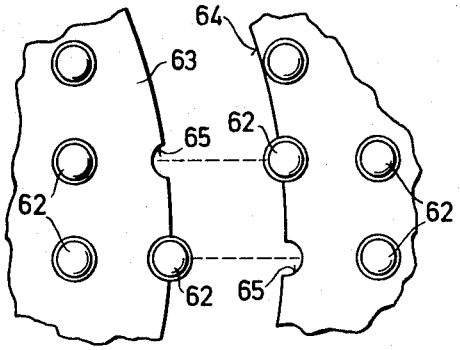
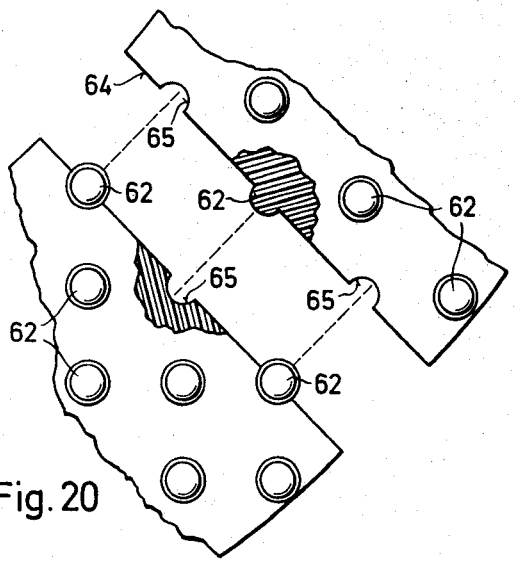
Fig. 20

DART AND DARTBOARD THEREFORRELATIONSHIP TO EARLIER APPLICATIONS

This application is a continuation-in-part of my patent application Ser. No. 812,701, filed July 5, 1977 now abandoned.

BACKGROUND OF THE INVENTION

This invention relates to a dart having a rounded nose-tip and to a dartboard for catching such darts, which dartboard comprises a supporting base having a front face and a rear face and on the front face projections protruding from the front face substantially perpendicularly thereto, uniformly spaced from one another and arranged in a regular pattern which extends over at least the major portion of the said front face of the supporting base, so as to hold fast a dart of the type described penetrating between at least two of the projections without the tip penetrating into the front face of the supporting base.

A dart and dartboard of this type are described in published German Patent application No. (Offenlegungsschrift) DE-OS 20 44 391 of Dierk Funke. However, this dartboard for catching "safety" darts, i.e. darts which do not have a sharp point destined for penetrating into the front face of the dartboard, but rather having a rounded forward end, has the drawback of being difficult to manufacture, if dartboards of conventional aspect are to be obtained.

Moreover, darts of this and similar known structure are not caught and held in a reliable manner, but frequently drop away from the dartboard after hitting it. Reasons for this failure of the dart to be caught on the dartboard in the position in which the tip of the dart impinges upon the dartboard are among others, lack of force of penetration of the dart and, on the other hand, the elasticity of the dart-catching projections provided on the target face of the dartboard. Moreover the dart may be too long and/or too heavy to be held by the dart-catching projections of the dartboard.

One particular drawback of darts having a plurality of needles or the like projections at its front tips (e.g. those shown in the aforesaid DE-OS of Dierk Funke, or those shown in FIGS. 3 to 5 of U.S. Pat. No. 3,949,989) becomes noticeable when the dart hits a board of the type described in the above-mentioned DE-OS or such patents as U.S. Pat. No. 3,894,736 or 3,949,989 at an angle deviating by about one degree or even a few degrees from the perpendicular on the board. Due to the elasticity of the pin-shaped projections on the board and of the needles or bristles of the dart tip, the dart will be prevented by friction and elastic transverse forces from penetrating fully into the layer of projections on the board, the weight of its part left protruding rearwardly from that layer will be too heavy and the dart will fall off the board.

Conventional dartboards either represent circular and annular zones of different colours, increasing counting values being attributed to such zones from the periphery towards the center of the dartboard. Instead of coloured ring zones, the front face of the dartboard may also bear the picture of an animal, e.g. a stag, a deer, a pheasant or a capercailzie.

The known dartboard disclosed by Dierk Funke, and others mentioned supra, are to be manufactured by assembling on a supporting base a circular centerpiece and, about the latter, successive rings of increasing internal width obtained, for instance, by injection molding. The dart-catching projections of these known dartboards are preferably in the form of pegs arranged in a pattern whereby a dart is caught between three or more pegs, an arrangement of square areas each defined by four pegs at its corners being most preferred. Such a pattern can not be subdivided into annular zones without having the limits of the latter intersect several of the pegs.

OBJECTS AND SUMMARY OF THE INVENTION

It is therefore an object of the invention to provide a novel dart having a rounded nose tip which dart is adapted for penetrating into a layer of dart-holding projections of elastically deformable or resilient material provided on a dartboard and overcoming repellant forces generated by elastic deformation of such projections.

It is another object of the invention to provide a combination of a dart of the above-mentioned type and a dartboard, wherein the dartboard bears a layer of dart-holding projections and the dart and projections are adapted for positive engagement with one another when the nose part of the dart has fully penetrated the said layer of projections.

It is yet another object of the invention to provide a dartboard bearing a layer of dart-holding projections, wherein the projections are provided with dart-engaging means adapted for positive engagement with a dart equipped with corresponding engagement means.

In a first aspect of the invention, a dart of the initially described type comprises (a) a cone-shaped nose part having a base and a rounded tip, destined to penetrate between said dart-holding projections of a dartboard, (b) a tail part bearing fins and (c) a stem part connecting the tail part with the base of the nose part, and (d) a ballast member intermediate the tail part and the nose part and being adaptable for being shifted during flight from a position adjacent the tail part toward said nose part.

Preferably, the ballast member is guided along the stem part while being shifted from a position adjacent the tail part toward the nose part and can be returnable from a position remote from the tail part to the position adjacent the latter.

Preferably, the ballast member is cylindrical and has an axial bore through which the stem part extends. When the stem part is of a diameter smaller than that of the base of said nose part, while the diameter of the bore of the cylindrical ballast member is smaller than, or equal to, that of the radial diameter of the stem part, there is achieved a frictional engagement of the ballast member on the stem part. Preferably, the tail part has a base facing toward the nose part and a central axial recess in the said base for receiving a portion of the stem part therein. This portion of the stem part is lodged frictionally and retractably in the central axial recess, whereby, upon retraction of the stem part from the recess by a short length, an annular groove can be formed between the tail part base and a rear end of the cylindrical ballast member when the latter has been shifted away from the tail part.

In a preferred embodiment which is easy to manufacture by injection molding, the stem part is integral with the nose part.

A dart game according to another aspect of the invention consists essentially of a novel dart as described hereinbefore, and a dartboard comprising (α) a base part having a front face, (β) a layer of dart-holding projections on the said front face, each of which projections protrudes substantially at right angle from the front face and is elastically flexible and deflectable by the nose part of the novel dart when the latter penetrates into the said layer, and (γ) engagement means on both the dart and the projections; the engagement means of the dart being adapted for engaging the engagement means of at least two of the projections when the dart has penetrated into the said layer and the blunt tip of its nose part is at or near the said front face of the dartboard.

Preferably, in the dart game, in the dart of which, upon retraction of the stem part from the recess by a short length, an annular groove is formed between the tail part base and the rear end of the cylindrical ballast member when the latter has been shifted away from the tail part, the engagement means of the projections on the dartboard comprise annular beads at or near the free end of each of the projections at a height of the latter corresponding to the distance of the said groove, formed at the rear of the ballast member of said dart, from the tip of the nose of the dart.

In another embodiment of the dartboard, the engagement means of the projections comprise ribs protruding radially from the sidewalls of the projections and extending in a direction substantially perpendicular to the front face area defined between from three to four of the said ribs; these ribs project from at least two adjacent ones of the said projections being of slightly smaller cross-sectional area than the largest cross-sectional area of the dart, thereby gripping the dart frictionally when the latter penetrates into the space.

In a first mode of carrying out the invention in practise, a dartboard of the initially described type has a supporting base of transparent material which comprises, on its rear face, means for attaching a design-bearing element showing on the side thereof coming into contact with said rear face of said supporting base a design of the differently coloured target areas.

In a preferred embodiment of the dartboard according to the invention, the projections are arranged in a pattern of concentric circles, each projection being a ring wall preferably integral with the supporting base.

In another embodiment of the dartboard according to the invention, the supporting base bears on its front face a plurality of peg-shaped projections protruding from the said front face substantially, perpendicularly thereto, which pegs are uniformly spaced from one another and arranged in a regular pattern, and a cover plate covering the front face of the supporting base and having holes through which the pegs protrude, extending beyond the outer face of the cover plate away from the supporting base; the outer face of the cover plate showing target areas of different colouring or a design such as an animal.

In yet another embodiment of a dartboard according to the invention, the projections protruding from the front face of the supporting base substantially perpendicularly thereto are uniformly spaced from one another and arranged in continuous concentric circles which pattern extends over the front face of the supporting base so as to hold fast a blunted tip of a dart penetrating between at least two of the projections adjacent one another without having the tip penetrate into the front face of the supporting base.

The circular projections and the supporting base can then be integral with one another and of transparent material, with the supporting base comprising, on its rear face, means for attaching a design-bearing element showing on the side thereof coming into contact with the rear face of the supporting base a design of differently coloured target arears.

In this embodiment, at least the innermost circular projection and preferably all of the projections have a plurality of axial slots therein extending from the free circular rim of each slotted projection towards the front surface of the supporting base. This renders the walls more flexible in their upper portions and facilitates penetration of a dart tip therebetween.

In this embodiment, the supporting base can also be composed of a plurality of base segments and each circular projection can then be composed of a plurality of wall segments, each of which wall segments is preferably integral with its corresponding base segment and extends through the same angle as the said base segment.

In this embodiment, the said circular projections can have as dart-engaging means each a circumferential bead at or near the free end rim of the projections.

These circumferential beads preferably extend in a plane substantially parallel with the front face of the supporting base.

Moreover, each of these circular projections having the aforesaid circumferential bead at or near its free end rim can have at least one additional circumferential bead parallel to the uppermost bead and closer to the foot of the circular projection.

In a similar embodiment of the dartboard, the projections can be arranged in continuous concentric circles, and the supporting base can have the configuration of a wheel having as its hub a central target area of circular shape, an annular rim part at its periphery, and a plurality of spokes extending radially from the said central target area to the annular rim part.

These circular projections can be provided with axially extending ribs on the annular wall faces thereof turned toward one another, which ribs serve as dart-engaging means.

The circular projections then are preferably ring walls having a foot portion which is mounted on the said spokes of the wheel-shaped supporting base.

Also in this embodiment, at least some and preferably all of these circular projections can have, as dart-engaging means, circumferential beads at or near the free end rims of the projections, which circumferential beads preferably extend in a plane substantially parallel with the front face of said supporting base.

In yet another embodiment of a dartboard according to the invention, the projections are shaped as pegs which are preferably integral with a composite supporting base, and the target shows on its front face target areas of which adjoining ones can have different colouring. The composite supporting face consists of a plurality of segments, the front faces of at least part of which segments have at least one or several edges common to two adjoining segments, which edges intersect at least one of the preferably peg-shaped projections; such intersected projections are integral with one of the two segments having the intersecting edge in common, the foot of such intersected projection protruding laterally from the respective intersecting edge of the segment with which the projection is integral, while the adjoining segment has at the common edge a corresponding indentation, whereby the uniform pattern of the projections over the combined front faces of both these segments is maintained, each of the target areas comprising at least one of these two segments.

In a preferred variation, the front faces of the segments have the shape of sectors of a circle.

In another variation, one of the segments is a central segment the front face of which has the shape of a rotation-symmetrical polygon, adjoining segments have the shape of trapezoids or polytrapezoids. By "polytrapezoid" is meant a combined area of two or more trapezoids, which abut with one of their non-parallel sides so that their smaller parallel sides are joined along an inner edge and their larger parallel sides are joined along an outer edge.

The central segment can be a triangle, a square, a pentagon, a hexagon or a higher polygon.

In a most preferred embodiment, one of the segments is a central segment, the front face of which has a circular edge and at least a part of the other segments are arranged about the central segment to form a plurality of rings therearound, all of the segments forming a ring about the central segment of identical colouring. Preferably any two rings in contact with one another have different colouring.

The pegs may also be arranged in such a pattern that none of them is intersected by one of the aforesaid curved edges common to two segments on the supporting base. In this case, however, the overall pattern of the pegs on the front face of the target will become irregular and the pegs must be sufficiently elastically flexible and sufficiently close together to enable the dart-engaging means of a group of several of these pegs to safely catch a dart according to the invention.

BRIEF DESCRIPTION OF THE DRAWINGS

Various embodiments of the invention shall now be explained in more detail with reference to the accompanying drawings in which:

FIG. 1 is a lateral view of a preferred embodiment of the dart according to the invention as assembled during manufacture;

FIG. 2 is an axial sectional view of the front and central portion of the dart of FIG. 1;

FIG. 3 is an axial sectional view similar to that of FIG. 2, but with the stem of the nose part pulled part of the way out of a recess in the tail part;

FIG. 6 is a perspective view of a curved segment being part of the embodiment shown in FIG. 5;

FIG. 8 shows a top view of another, preferred embodiment in which the supporting base has the aspect of a wheel bearing circular wall portions;

FIG. 9 shows a cross-sectional view similar to that of FIG. 6 as part of the embodiment of the dartboard shown in FIG. 8;

FIG. 10 shows in perspective view a segment similar to that shown in FIG. 6, but differently mounted on a supporting base;

FIG. 11 shows the embodiment of the dart of FIGS. 1 to 3 and part of a dartboard similar to that shown in FIGS. 8 and 9 in three different phases of a dart game;

FIG. 12 shows a cross-sectional view similar to that of FIG. 9 of projections having a different kind of dart engaging means and being mounted in an embodiment of the dartboard similar to that of FIG. 8;

FIG. 13 shows in top view a fourth embodiment of the dartboard, of which

FIG. 13A is an enlarged cut-out;

FIG. 14 is a sectional view of part of the embodiment shown in FIG. 13;

FIG. 15 is a perspective view of two circular projections being part of the embodiment of the dartboard shown in FIGS. 13 and 14;

FIG. 17 is a top view of a sixth embodiment of the dartboard, in which the front face of the dartboard is subdivided into a central circular segment and several arcuate segments arranged in four rings about the central segment;

FIG. 18 is a lateral view of the embodiment shown in FIG. 17;

FIGS. 19 and 20 are exploded cut-out views of portions of the embodiment of FIGS. 17 and 18, correspondingly indicated by "XIX" and "XX" in FIG. 17;

DETAILED DESCRIPTION OF THE EMBODIMENTS SHOWN IN THE DRAWINGS

Figure 4:
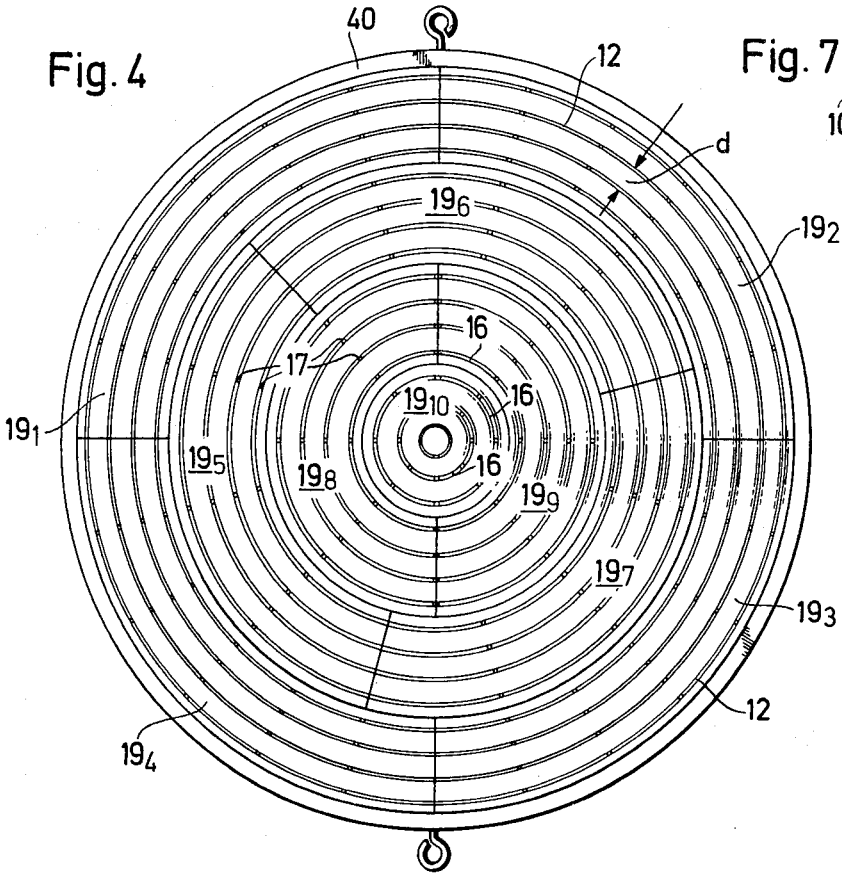
FIG. 4 is a front view of a first embodiment of the dartboard according to the invention bearing circular wall projections.
Figure 7:
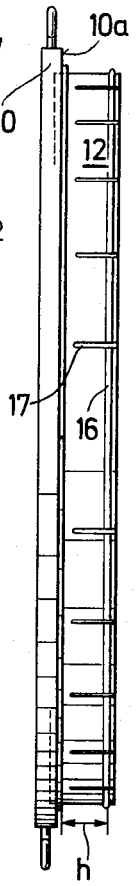
FIG. 7 is a lateral view of the embodiment of the dartboard shown in FIGS. 4 and 5.
Figure 5:
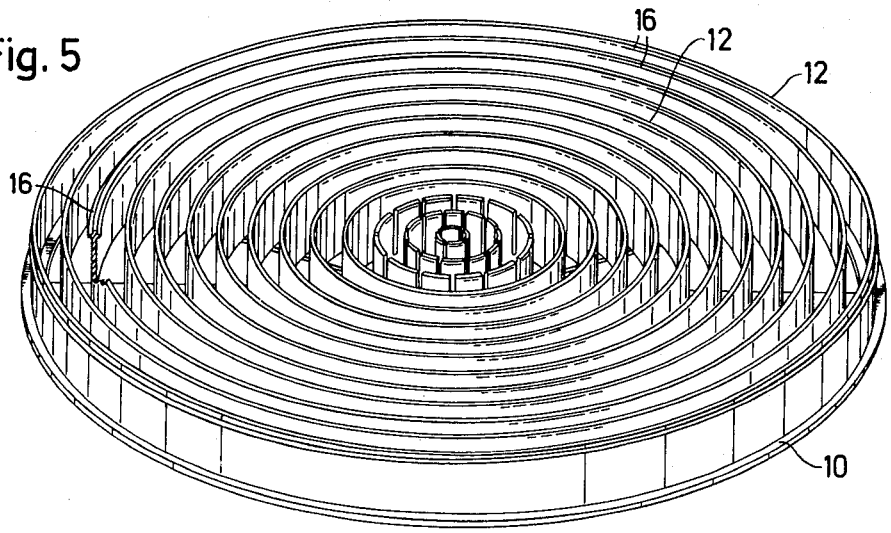
FIG. 5 is a perspective view of the embodiment of the dartboard shown in FIG. 4.

The embodiment of a dart 1 according to the invention shown in FIGS. 1 to 3 comprises a cone-shaped nose part 2 which has a base 3 and a rounded tip 2*a*, and bears, protruding from its base 3, a stem 4. On the stem or peg 4 there is mounted a ballast member 5 of cylindrical shape which has a central bore or passage 6 the inner width of which is preferably slightly larger than the diameter of the stem 4, thus permitting a snug seat, but easy axial displacement without any substantial radial play. The free end portion 4*a* of the stem 4 is pressure-seated fully in a recess 7 of a tail part 8, recess 7 being of practically the same or slightly smaller width than the outer cross-sectional diameter of the peg 4. For reasons of easier manufacture, the rearward free end 4*a* of peg 4 is , at least initially, so far introduced into recess 7 that the ballast member 5 abuts with its rearward end face 5*b* against the flat forwardly directed front face 8*a* of tail part 8 and with its front face 5*a* against the base 3 of nose part 2.

With both the tail part 8 and the internal nose part 2 and stem 4 being of synthetic plastics material which is preferably slightly elastically compressible or deformable, stem 4 can be pressed fixed into recess 7, but can also be withdrawn a short way therefrom thus forming an annular groove or gap 9*a* about the stem portion 4*b* which then protrudes from ballast member 5, the gap 9*a* being located between base 3 of the nose part 2 and front face 5*a* of ballast member 5.

The ballast member 5 is preferably of a heavier material than the remainder of the dart 1, for instance, steel or the like heavy metal.

While the newly manufacture dart has the ballast member 5 in the position shown in FIG. 2 firmly wedged in between the nose part 2 and the tail part 8 of the dart, the ballast member 5 can be moved forward and backward on stem 4 when the parts are in the position showwn in FIG. 3.

The surface of the plastics stem 4 is thus smoothed gradually until the ballast member can be displaced easily from its rearward position shown in FIG. 3 and FIG. 11(A), in which its rear end face 5*b* is in contact with front face 8*a* of the tail part 8, to a forward position (shown in FIG. 11(B), in which the front face 5*a* of the ballast member 5 rests against the base 3 of nose part 2, thus producing an annular gap 9*b* about the stem 4, nearer the free end 4*a* of the latter, between front face 8*a* of the tail part 8 and rearward end face 5*b* of ballast member 5.

The tail part 8 of the dart 1 is provided with the usual fins 13 in a conventional manner.

The embodiment of a dartboard according to the invention shown in FIGS. 4 to 7 comprises a supporting base 10 in the shape of a circular disc which has a front face 10*a* and a rear face 10*b*. On its front face 10*a*, the base 10 bears a number of annular walls 12 which are made integral with the supporting base 10 and protrude from the front face 10*a* of the latter. The distance d between neighbouring walls 12 is sufficiently smaller than the width e of dart 1 (FIGS. 1 and 2), so that the walls 12 which are slightly elastically deformable will grip the dart 1 before the tip of nose part 2 of dart 1 can impinge too hard upon and damage front face 10*a* of base 10. The height h of the ribs 16 on the walls 12 above the front face 10*a* of base 10 must be sufficient for this purpose. Annular walls 12 are arranged concentrically on front face 10*a*.

As shown in FIG. 6, the walls 12 bear at a level near or at the upper rims 12*a* on the lateral surface of each wall 12 facing toward another such wall 12 an annular rib or bead 16. These annular ribs 16 which project from the lateral sides of wall 12 in a horizontal plane parallel to the plane of base 10, i.e. radially relative to the central axis of the latter, are of such size that they fit readily into the gap 9*b* formed on dart 1 during flight when the ballast member 5 moves forward due to inertia when the nose tip 2 of dart 1 contacts, and is braked by, walls 12 of the dartboard (FIG. 11, position C).

In order to provide sufficient elasticity especially of the innermost ring walls 12, axial slots 17 extending from the outer rim 12*a* of these innermost ring walls 12 toward the front face 10*a* are provided in these walls (FIGS. 4, 6 and 7) and, in the case of relatively stiff material being used for making the dartboard, these slots 17 can be provided in all of the ring walls 12. In order to simplify manufacture, supporting base 10 need not be produced as a single piece, but it can be composed of a number of segments 19, one of which is shown in FIG. 6. These arcuate segments 19 of ring walls 16 can be injection-molded with the walls 12 integrally with a base portion 18; the necessary number of such segments 19 can then be assembled on the supporting base 10 to form the target and they can be held together by means of circumferential rim 40. The rear faces of segments 19 can be provided with studs 19*a* by means of which the segments 19 can be fastened on base plate 10, which, in this case, has correspondingly arranged holes in its front face 10*a* for receiving studs 19*a* therein. As shown in FIG. 4, there are nine segments $\mathbf{19}_1$ to $19_9$ as well as a central circular segment $\mathbf{19}_{10}$. About the latter, a first ring zone is obtained by assembling thereto half ring segments $\mathbf{19}_8$ to $\mathbf{19}_9$. By manufacturing these two half segments in a colour different from that of central segment $\mathbf{19}_{10}$, and by assembling about the ring zone of segments $\mathbf{19}_8$ and $\mathbf{19}_9$ a second ring zone of three arcuate segments $\mathbf{19}_5$, $\mathbf{19}_6$ and $\mathbf{19}_7$, each of which latter three segments covers an angle of 120° and is of the same colour as the other two segments of this same ring zone, but of a colour different from that of the ring zone of segments $\mathbf{19}_8$, $\mathbf{19}_9$, a target comprising three different zones is obtained which can then be enlarged by an outermost ring zone composed of four arcuate segments $\mathbf{19}_1$, $\mathbf{19}_2$, $\mathbf{19}_3$ and $\mathbf{19}_4$. The latter ring zone can also have its own distinctive colouring.

In the embodiments shown in FIGS. 8 to 15, the ring walls 22 are not integral with a base, but are inserted on the front faces of radial spokes 23 which connect a central hub piece 24 with a peripheral rim 25 in the manner of a spoked wheel. FIGS. 9, 10, 12 and 14 illustrate different ways for mounting ring walls 22 on spokes 23, e.g. by means of joggles achieved by providing notches 24 in the foot ends of ring walls 22 and notches 25 in the upper faces of spokes 23 which serve as joists. While FIG. 9 shows one of these pairs of elements in exploded view, the left-hand pair in FIG. 9 and FIG. 12 show the completed joggles. Ring walls 22 are provided with annular beads 26 extending in planes parallel to the supporting base and serve as dart-engaging means. In FIG. 9, these beads 26 are provided one each close to the upper free rim 22*a* of the ring wall 22, while in FIG. 12, three such beads 26, 28 and 29 are provided at different levels above the supporting base. For the purpose of convenient manufacture by injection-molding, ring walls 22 having these beads are preferably sub-divided into segments.

When using ring walls having bead arrangements as shown in FIG. 12, the dart 100 to be engaged thereby comprises preferably a nose part 102 and a ballast member 105 having transversely extending circumferential grooves 109 spaced from one another by the same distances as the ridges of annular beads 26, 28 and 29, and a central bore 106 through which stem 104 joining nose part 102 to tail part 108 extends.

Another mode of mounting ring walls 32 composed of segments 35 on the front face 30*a* of supporting base plate 30 is carried out by molding a group of several ring walls 32 bearing annular ribs 36 as dart-engaging means on short radially extending joist segments 38. In FIG. 10, three wall segments 35 are injection-molded integrally with three radial joist segments 38. On their undersides, these joists can be provided with pins 38*a* which press-fit into corresponding holes 37 in the front face 30*a* of target board 30.

A similar mounting as in FIGS. 9 and 12 is also shown in the embodiment of FIGS. 13 to 15, however, ring walls 42 are provided with axially extending ribs 43, which protrude from the inner and outer faces of ring walls 42 except in the case of outermost ring wall 44 which bears these ribs only on its inside face.

In this case, it is not absolutely necessary to form a gap 9a or 9b between ballast member 5 and the nose part 2 or tail part 8 of dart 1, but it can be sufficient to provide part of, or the entire cylindrical surface of ballast member 5 with an axial chamfering or grooving which will enhance the grip of dart-engaging ribs 43 on the dart 1 in the region of the ballast member. Even in this type of dart-engagement according to the invention, it is desirable to provide for the above-described gap 9a before throwing the dart 1 or 100, in order to achieve the final penetrating impact which the ballast member 5, 105 exercises on the nose part 2, 102 when it moves forward along stem 4, 104 as the nose part 2, 102 of the dart is braked by a dart-catching element or elements of the dartboard.

Further embodiments of dartboards which can be used in a dart game as targets for the dart shown in FIGS. 1 to 3, are illustrated in FIGS. 16 to 23.

Figure 16:
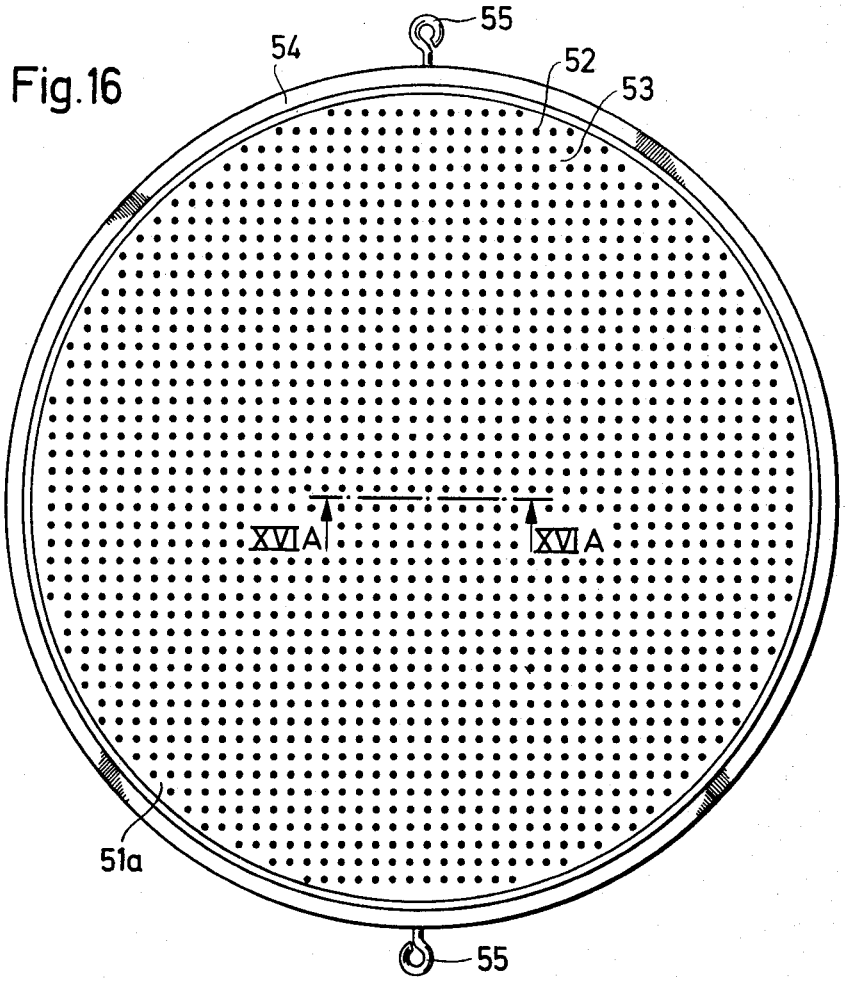
FIG. 16 is a front view of a fifth embodiment of the dartboard bearing circular wall sections and yet another type of dart-engaging means associated with the projections thereof.
Figure 16A:
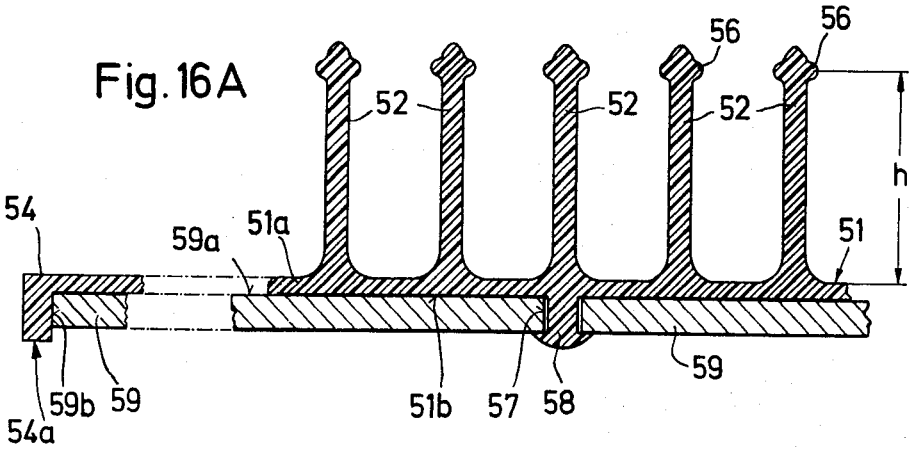
FIG. 16A is a cross-sectional view of a central portion of the embodiment shown in FIG. 16, as indicated by XVIA—XVIA therein.

The embodiment of FIGS. 16 and 16A comprises a supporting base 51 bearing on its front face 51a a large number of projections in the shape of catching pegs 52. These pegs 52 are arranged to form corners of small squares 53. The base 51 is provided with a circumferential rim 54 in which two hooks 55 are inserted, for instance by means of a screw connection, which hooks serve for fastening or suspending the dartboard in vertical position. On the rear face 51b of base 51 there is attached a target board 59 showing a design 59a of target areas in different colours on its face contacting the rear face 51b of base 51. Supporting base 51 is made of transparent synthetic plastics material, e.g. polyethylene or polypropylene. The target board 59 can be of any material suitable for carrying the design, e.g. cardboard, paper, metal, any synthetic plastics material or glass. The target board 59 can be fastened in the marginal rim 54a of base 51, for instance by gluing it in along its periphery 59b. The target board 59 can have a central hole 57 into which a pin or rivet 58 protruding from the rear face 51b of base 51 can be inserted.

Preferably, the pegs 52 are provided with dart-engaging annular flanges or beads 56 at a height h above the front face 51a of the dartboard.

Preferably, base 51 and pegs 52 are made integral with one another, for instance as a single injection-molded piece. Instead of affixing a target board 59 on the rear face 51b of base 51, a design-bearing disc having approximately the same size as base 51 and being provided with holes which are equal in number and position with the number and position of pegs 52 and of slightly larger diameter than the latter can be placed, with pegs 52 protruding through these holes, on the front face 51a of base 51. As it is easier to make pegs 52 integral with base 51 by providing them with broadened feet 52a, it is preferable to maintain the superimposed design-bearing disc slightly spaced from front face 51a of base 51. This can be achieved by providing on front face 51a a number of spacing studs upon which the disc comes to rest.

In the embodiments shown in FIGS. 17 to 23, the dart catching projections are again in the shape of pegs 62 which are made integral with base segments 61, 63 of different shape for easier manufacture of the composite supporting base 60.

Figure 22:
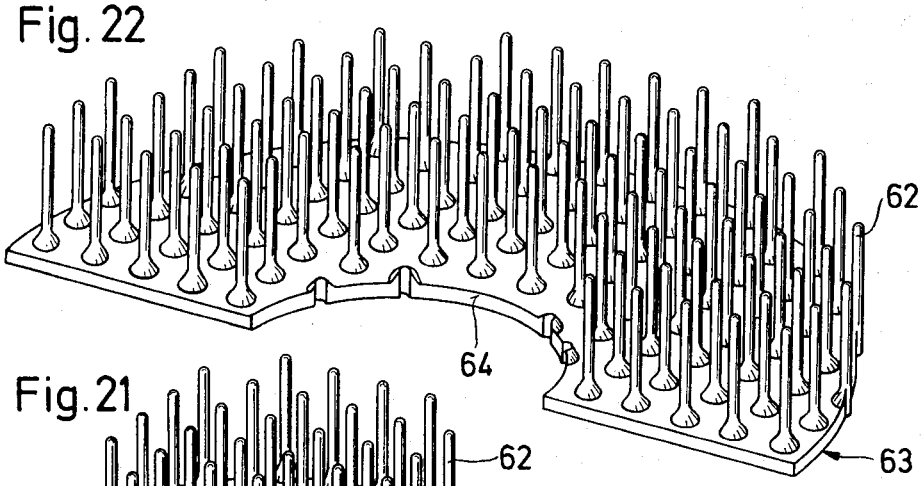
FIG. 22 is a perspective view of an arcuate segment next adjacent the central segment of FIG. 21, both segments pertaining to the embodiment shown in FIGS. 17 and 18.
Figure 21:
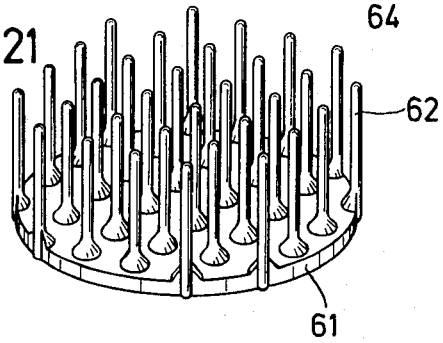
FIG. 21 is a perspective view of the central segment.
Figure 23:
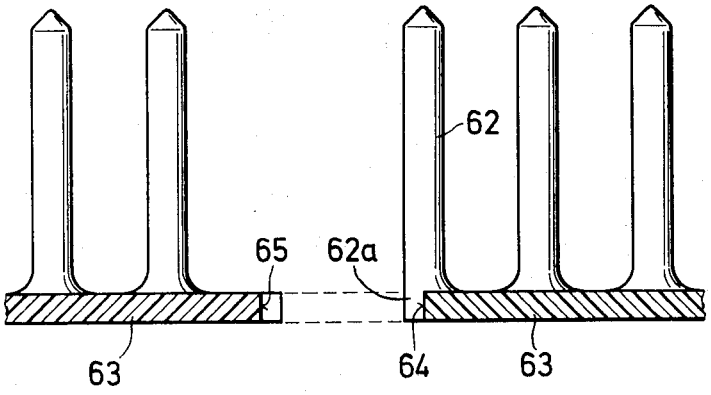
FIG. 23 shows schematically portions of the segments of FIGS. 21 and 22 to be engaged.

The preferred embodiment of this type of dartboard is illustrated in FIGS. 17 to 23. In this embodiment, the front face and peg arrangement is built up from a circular centerpiece 61 and arcuate segments 63 which are arranged in four ring zones whose inner diameter increases toward the periphery of the dartboard. FIG. 21 shows the centerpiece 61 which bears pegs 62 and FIG. 22 shows a next-adjacent arcuate segment 63, also bearing pegs 62, which are produced by injection-molding as integral pieces. The pegs 62 are distributed over the entire front face in a regular, uniform pattern, four adjacent pegs always forming the corners of a square dart-catching area. Of course, it is also possible to arrange always three pegs in the corners of a triangle, or six pegs in the corners of a symmetrical hexagon. If this pattern is to be strictly maintained, it is practically unavoidable that the border edges along which two segments in these embodiments contact each other intersect some of the pegs. To use split pegs causes problems because the split pegs would have to be fastened together, for instance by gluing, to avoid their being bent apart and thereby disturbing the catching of the dart. It is therefore an important feature of the invention that these pegs which sit across the straight or curved edges of the segments in this embodiment are not split but are molded integrally with one of the two segments which have the intersecting edge 64 in common, while the other segment has a corresponding indentation 65. The laterally protruding foot end 62a of a marginal intersected peg 62 fits into the indentation 65 located opposite that marginal peg in the adjoining segment.

A relatively small weight of the ballast member 5, 105 is required in the novel type of dart. Of course, the shape and arrangement of the segments of the dartboard and of the projections thereon can be varied within a wide range. The segments can be connected with one another or with a supporting base by any suitable method, such as joggling, gluing, riveting, welding or by screw-connections.

I claim:

1. A dart game consisting essentially of a dart comprising (a) a cone-shaped nose part having a base and a rounded tip, (b) a tail part bearing fins, (c) a stem part connecting said tail part with the base of said nose part, and (d) a ballast member mounted on said stem part intermediate said tail part and said nose part and in contact with said tail part, the distance between said tail part and nose part and the length of said ballast member, along said stem part, being so adjustable relative to one another that said length of the ballast member is shorter than said distance, said ballast member thereby being shiftable during flight from its position adjacent said tail part toward said nose part, and thereby producing an annular groove about said stem part between said ballast member and said tail part;

and a dartboard comprising (α) a base part having a front face, (β) a layer of dart-holding projections on said front face, each of said projections protruding substantially at right angle from said front face and being elastically flexible and deflectable by the nose part of said dart when the latter penetrates into said layer, and (γ) engagement means on both said dart and said projections, said engagement means of said dart being adapted for engaging said engagement means of at least two of said projections when said dart has penetrated said layer and the blunt tip of said nose part is at or near said front face, said engagement means of said projections comprising annular beads at or near the free end of each of said projections at a height of the latter corresponding to the distance of said annular groove, formed at the rear of the ballast member of said dart, from the tip of the nose of said dart.

2. The dart game of claim 1, wherein said tail part of said dart has a base facing toward said nose part and a central axial recess in said base for receiving a portion of said stem part therein, said portion of said stem part being lodged frictionally and retractably in said central axis recess, whereby, upon retraction of said stem part from said recess by a short length, said annular groove is formed between said tail part base and a rear end of said ballast member when the latter has been shifted away from said tail part.

* * * * *